US010319167B1

(12) United States Patent
Oesterling et al.

(10) Patent No.: US 10,319,167 B1
(45) Date of Patent: Jun. 11, 2019

(54) SYSTEMS AND METHODS FOR PEER-TO-PEER VEHICLE SHARING

(71) Applicant: GM Global Technology Operations LLC, Detroit, MI (US)

(72) Inventors: Christopher L. Oesterling, Troy, MI (US); Dwayne A. Crocker, Lake Orion, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/898,734

(22) Filed: Feb. 19, 2018

(51) Int. Cl.
*G08G 1/00* (2006.01)
*G07C 9/00* (2006.01)

(52) U.S. Cl.
CPC ..... *G07C 9/00896* (2013.01); *G07C 2009/00587* (2013.01); *G07C 2009/00984* (2013.01)

(58) Field of Classification Search
CPC .... G07C 9/00896; G08B 29/00; G06Q 10/00; G06Q 10/02; G06Q 30/0645
USPC ..... 340/901, 5.1, 5.2, 5.8, 309.16; 705/5, 59
See application file for complete search history.

(56) References Cited

U.S. PATENT DOCUMENTS

2011/0191126 A1* 8/2011 Hampshire ..... G06Q 10/02 705/5
2013/0325521 A1* 12/2013 Jameel ..... G06Q 10/02 705/5
2017/0178035 A1* 6/2017 Grimm ..... H04L 63/061
2018/0154867 A1* 6/2018 Golduber ..... G06Q 10/02
2018/0262891 A1* 9/2018 Wu ..... H04W 4/00

* cited by examiner

*Primary Examiner* — Toan N Pham

(57) ABSTRACT

According to one example, a key fob for peer-to-peer vehicle sharing is provided. The key fob includes a communications module and a remote enablement module. The communications module is configured to obtain a remote enablement command indicating a rental period for a vehicle associated with the key fob. The remote enablement module is configured to enable one or more functions of the key fob during the rental period based on the remote enablement command.

19 Claims, 7 Drawing Sheets

SYSTEMS AND METHODS FOR PEER-TO-PEER VEHICLE SHARING

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to systems and methods for peer-to-peer vehicle sharing and, more particularly, to systems and methods for peer-to-peer vehicle sharing utilizing a dedicated key fob.

Peer-to-peer vehicle sharing is a service that allows vehicle owners to rent their vehicles to interested parties for a fee. Accordingly, vehicle owners participating in a peer-to-peer vehicle sharing service may derive income from their vehicles during time periods when they, themselves, are not using their vehicles. In addition, peer-to-peer vehicle sharing offers parties in need of transportation quick access to nearby and affordable vehicles.

SUMMARY

In a feature, a key fob for peer-to-peer vehicle sharing is provided. The key fob includes a communications module and a remote enablement module. The communications module is configured to obtain a remote enablement command indicating a rental period for a vehicle associated with the key fob. The remote enablement module is configured to enable one or more functions of the key fob during the rental period based on the remote enablement command In another feature, the communications module is further configured to (i) obtain first authentication data from an electronic device associated with a user and (ii) obtain second authentication data from a server.

In one feature, the key fob also includes an authentication module. The authentication module is configured to (i) compare the first authentication data with the second authentication data and (ii) authenticate the electronic device associated with the user if the first authentication data correlates to the second authentication data.

In another feature, the remote enablement module is configured to enable the one or more functions based on the authentication module authenticating the electronic device.

In a feature, the key fob also includes a timer module. The timer module is configured to start a timer at a begging of the rental period, stop the timer at an end of the rental period, and transmit a rental period expiration notification to the remote enablement module at the end of the rental period.

In another feature, the remote enablement module is further configured to disable the one or more functions of the key fob in response to obtaining the rental period expiration notification.

In one feature, the key fob also includes a power control module. The power control module is configured to transition the key fob from a first energy state to a second energy state during the rental period in response to the remote enablement module enabling the one or more functions of the key fob.

In a feature, the first energy state includes a higher energy state than the second energy state.

In one feature, a server computer is provided. The server computer includes a processor, memory, and a peer-to-peer vehicle share application that is stored in the memory and executed by the processor. The processor is configured to execute the peer-to-peer vehicle share application to: obtain a vehicle rental request from an electronic device associated with a user, wherein the vehicle rental request comprises a location of the electronic device; identify a particular vehicle from among a plurality of vehicles to satisfy the vehicle rental request based on at least the location of the electronic device; transmit a vehicle assignment to the electronic device, wherein the vehicle assignment comprises a location of the particular vehicle and identification information associated with the particular vehicle; determine whether an unlock condition associated with the particular vehicle has been satisfied; in response to determining that the unlock condition associated with the particular vehicle has been satisfied, unlock one or more doors of the particular vehicle; and enable a key fob associated with the particular vehicle for a rental period.

In another feature, the peer-to-peer vehicle share application is configured to determine whether the unlock condition associated with the particular vehicle has been satisfied by obtaining a vehicle unlock request from the electronic device associated with the user.

In one feature, the peer-to-peer vehicle share application is configured to determine whether the unlock condition associated with the particular vehicle has been satisfied by determining that the electronic device associated with the user is within a predetermined proximity of the particular vehicle.

In a feature, the peer-to-peer vehicle share application is configured to determine that the electronic device associated with the user is within the predetermined proximity of the particular vehicle by comparing the location of the electronic device with the location of the particular vehicle.

In another feature, the peer-to-peer vehicle share application is configured to enable the key fob associated with the particular vehicle by transmitting an enablement command to a transceiver of the particular vehicle.

In one feature, the peer-to-peer vehicle share application is further configured to transmit authentication data associated with the electronic device to the key fob.

In a feature, the peer-to-peer vehicle share application is configured to transmit the authentication data associated with the electronic device to the key fob via a transceiver of the particular vehicle.

In another feature, another example of a key fob is provided. According to this example, the key fob includes a battery, a vehicle control circuit, and a controller. The vehicle control circuit is configured to transmit a fob enablement beacon, indicating that the key fob has been enabled, to a particular vehicle associated with the key fob when the vehicle control circuit is energized by the battery. The controller is configured to activate in response to obtaining a controller activation command, authenticate an electronic device associated with a user, and, in response to authenticating the electronic device, cause the battery to energize the vehicle control circuit.

In one feature, the controller is further configured to deactivate within a predetermined period of time after causing the battery to energize the vehicle control circuit.

In a feature, the controller is further configured to reactivate, after being deactivated.

In another feature, the controller is configured to reactivate after at least one of the following: (i) obtaining another controller activation command and/or (ii) a predetermined period of time has passed.

In one feature, the controller is further configured to de-energize the vehicle control circuit by preventing the battery from supplying power to the vehicle control circuit.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
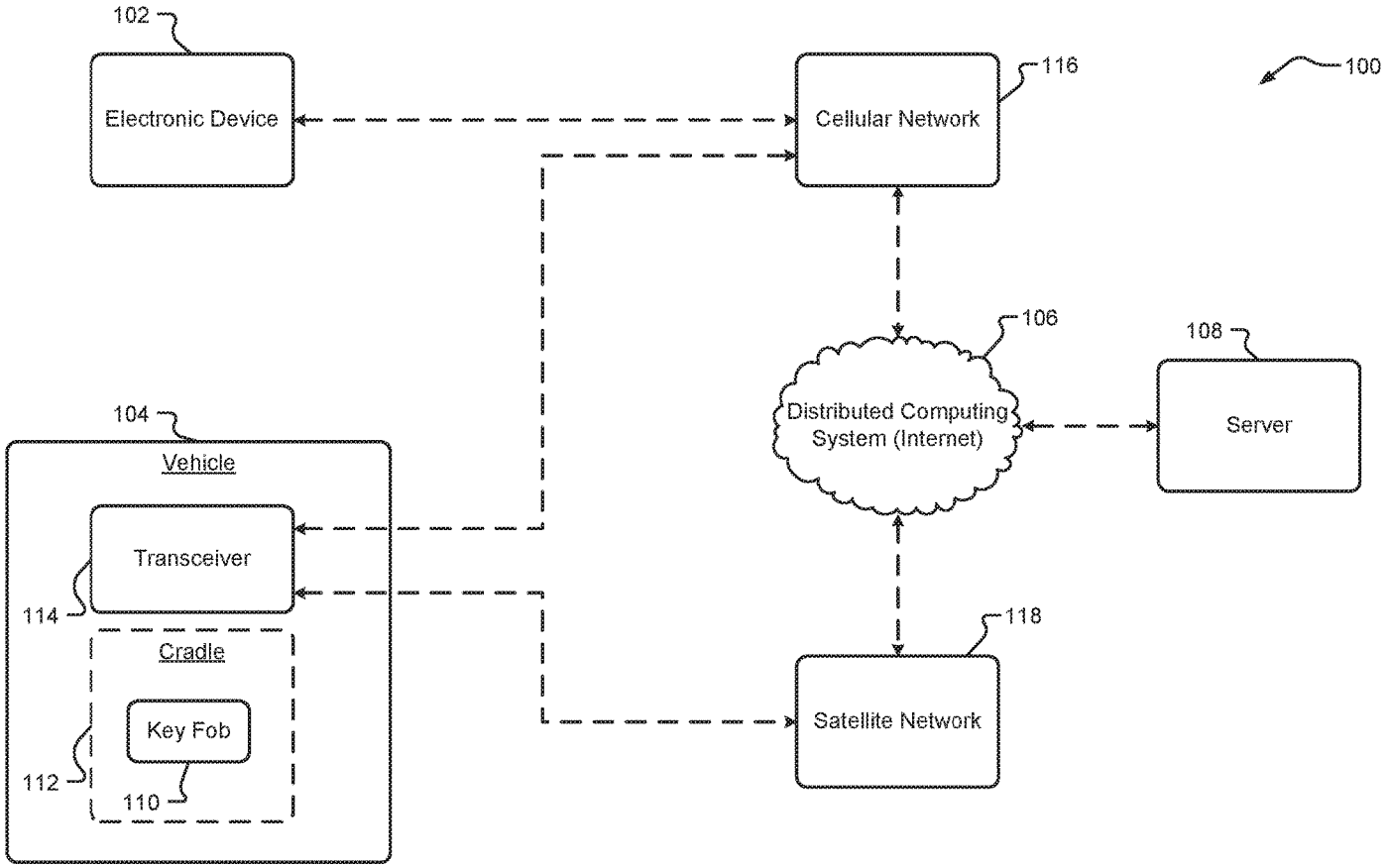
FIG. 1 is a functional block diagram of a system for providing peer-to-peer vehicle sharing according to an exemplary embodiment.

Peer-to-peer vehicle sharing allows vehicle owners to monetize their vehicles during periods when the vehicle owners themselves are not using their vehicles. In addition, parties in need of temporary use of a vehicle may obtain access to nearby and affordable vehicles. According to some examples, rental fees may be charged on a rolling basis (e.g., by the minute or hour), such that renters may only be charged for the specific amount of time that they use the rental vehicles. This stands in contrast to rental car companies, for example, that frequently charge a daily rate—even if the renter only needs the vehicle for less than a full day.

One way that peer-to-peer vehicle systems operate is by installing specialized hardware in rental vehicles. This hardware may facilitate operations such as un-locking or locking of the vehicle. However, installing specialized hardware may be expensive and time consuming. Moreover, the permanent installation of specialized hardware is intrusive with regard to the rental vehicle owner.

According to the present disclosure, systems and methods for peer-to-peer vehicle sharing utilize a specialized, dedicated key fob, which may be left in a vehicle available for rent when the owner of the vehicle is not present. According to one example, the key fob includes a battery, a vehicle control circuit, and a controller. The controller is configured to (i) activate in response to obtaining a controller activation command; (ii) authenticate an electronic device associated with a user of the peer-to-peer vehicle sharing system (e.g., a vehicle renter); and (iii) in response to authenticating the electronic device, cause the battery to energize the vehicle control circuit. Once energized, the vehicle control circuit is configured to transmit a fob enablement beacon indicating that the key fob is enabled. According to some examples, the fob enablement beacon may be transmitted constantly, periodically (e.g., at predefined intervals), or a single time. The fob enablement beacon may be received by the rental vehicle. According to some examples, receipt of the fob enablement beacon by the vehicle may serve as a precondition for the vehicle starting. In this way, a user, such as a vehicle renter, may gain access to, and use of, a rental vehicle included as part of a peer-to-peer vehicle sharing system without the need for specialized hardware in the rental vehicle.

The following disclosure will enable one skilled in the art to practice the inventive concept. However, the exemplary embodiments disclosed herein are merely exemplary and do not limit the inventive concept to exemplary embodiments described herein. Moreover, descriptions of features or aspects of each exemplary embodiment should typically be considered as available for aspects of other exemplary embodiments.

Throughout the disclosure, one or more of the elements disclosed may be combined into a single device or into one or more devices. In addition, individual elements may be provided on separate devices.

FIG. 1 illustrates one example of a system 100 for providing peer-to-peer vehicle sharing. The system 100 includes a rental vehicle 104, an electronic device 102 associated with a user (e.g., a vehicle renter) of the system 100, and a server computer 108. In the example of FIG. 1, the electronic device 104 is communicatively coupled with the server 108 via a cellular network 116 and a distributed computing system 106, such as the internet. The vehicle 104 is communicatively coupled with the electronic device 102 via the cellular network 116. According to other examples, the vehicle 104 is communicatively coupled with the electronic device 102 via short-wave radio wave communication protocols, such as Bluetooth® or the like. The vehicle 104, through its transceiver 114, is also communicatively coupled with a satellite network 118 (e.g., OnStar®). According to some examples, the vehicle 104 is communicatively coupled with the server 108 via the satellite network 118 and the distributed computing system 106. As described below and shown in greater detail with regard to FIG. 3A, according to some examples, a key fob 110 associated with the vehicle 104 may include one or more transceivers, and may be communicatively coupled with (1) the transceiver 114 of the vehicle 104 and/or (2) the electronic device 102 via the cellular network 116. According to other examples, the key fob 110 may be communicatively coupled with the electronic device 102 and/or the vehicle 104 via short-wave radio wave communication protocols, such as Bluetooth® or the like.

Although only a single vehicle 104, single electronic device 102, and single server computer 108 are shown in FIG. 1, according to certain examples, one or more vehicles, electronic devices, and/or server computers may be included as part of the system 100 without deviating from the teachings herein.

The rental vehicle 104 is depicted in the illustrated example as a passenger car, however, it should be appreciated that any other suitable vehicle including motorcycles, trucks, sports utility vehicles (SUVs), recreational vehicles (RVs), marine vessels, aircraft, etc., can be utilized as part of the system 100. According to some examples, a fleet of rental vehicles will be included as part of the system. In such examples, and as discussed in additional detail below, the server computer 108 is configured to identify a particular vehicle (e.g., vehicle 104) from among the fleet of available rental vehicles to satisfy a vehicle rental request received from the electronic device 102 associated with the user of the peer-to-peer vehicle rental system 100.

In the example shown in FIG. 1, the rental vehicle 104 has a key fob 110 stored therein. As used herein, a "key fob" constitutes a portable electronic device capable of controlling various parts of a vehicle. Among other possible functions, a key fob (e.g., key fob 110) may be configured to (i) lock and/or unlock vehicle doors; (ii) pop a trunk latch to open a vehicle trunk; (iii) remotely start a vehicle ignition; (iv) arm/disarm a vehicle security system; (v) activate a panic alarm; and/or (vi) control automatic windows.

With continued regard to FIG. 1, the key fob 110 may be stored anywhere in the vehicle 104 (e.g., in a center console, glove box, door panel, etc.). According to one example, the key fob 110 may be stored in a charging cradle 112. The charging cradle 112 may be utilized for key fob storage when, for example, the key fob 110 includes a rechargeable battery. As used herein, a "charging cradle" may include any suitable device capable of charging or recharging a battery of a key fob including, but not limited to, a cradle device or docking station, a charging pad, a charging mat, a charging cord that plugs into a female receptacle a key fob, etc. The charging cradle 112 may be omitted from the vehicle 104 in examples where the key fob 110 includes a non-rechargeable battery, such as a disposable battery.

The electronic device 102 associated with the user of the system 100 may include any suitable electronic device capable of wired or wireless communication with the vehicle 104 and/or server 108 including, but not limited to, a mobile phone, a smart phone, a tablet, a laptop computer, a desktop computer, a personal digital assistant (PDA), etc.

According to certain examples, the electronic device 102 includes a processor and memory configuration that executes a renter-side peer-to-peer vehicle sharing application. The renter-side peer-to-peer vehicle sharing application may allow a user to issue a vehicle rental request to the server 108. The vehicle rental request may indicate, at least, a location of the electronic device 102. In other examples, the vehicle rental request may also include a pickup location associated with the user/renter (e.g., in an implementation where the rental car is delivered to the user/renter) and/or a desired pickup location (e.g., a location other than the user's present location where the user/renter would like to pick up the rental vehicle). Further, according to some examples, the vehicle rental request may include a desired date and time (or timeframe, such as a rental period) associated with the vehicle rental. In some examples, the vehicle rental request may additionally include identification information associated with the user (e.g., name, age, address, driver's license number, etc.), payment information associated with the user (e.g., bank account information, credit card information, etc.), and/or rental request information (e.g., a timeframe for the requested rental, vehicle preference information indicating preferred vehicle characteristics such as vehicle type, available seating, gas mileage, etc.).

Details surrounding the server 108 are provided in additional detail below and with regard to FIG. 2.

In operation, the system 100 of FIG. 1 may function as follows. A user may issue a vehicle rental request from their electronic device 102 to the server 108. The server 108 may obtain the vehicle rental request and identify a particular vehicle (e.g., vehicle 104) from among a plurality of vehicles (e.g., a fleet of vehicles) to satisfy the vehicle rental request based at least on the location of the electronic device 102, the desired pickup location, and/or the desired pickup date/time. For example, the server 108 may identify, as the particular vehicle 104 to satisfy the vehicle rental request, a vehicle that is in closest proximity to the electronic device 102. In other examples, information other than the location of the electronic device 102 may be used as an additional, or alternative, basis for identifying the particular vehicle 104 to satisfy the vehicle rental request. For example, in some instances, identification information associated with the user, payment information associated with the user, and/or rental request information may be utilized in identifying the particular vehicle 104.

In addition, vehicle availability may be utilized by the server 108 in identifying a particular vehicle to satisfy the vehicle rental request. For example, the server 108 may consult a database indicating rental states associated with each of the vehicles included as part of the peer-to-peer vehicle sharing fleet. The rental states may identify each vehicle within the fleet as, for example, "available" or "unavailable" for rental (e.g., within the requested timeframe).

In some examples, the system 100 may require approval from the owner of the vehicle 104 identified to satisfy the vehicle rental request before the user/renter is actually able to access and utilize the vehicle 104. In such an implementation, the server 108 is configured to communicate with an electronic device associated with the owner of the vehicle identified to satisfy the vehicle rental request (not shown in FIG. 1) before a rental is finalized. In this example, the server 108 is configured to forward the vehicle rental request along to the electronic device associated with the owner of the vehicle. The server 108 may then receive either a rental approval or disapproval from the electronic device associated with the owner of the vehicle. Upon receiving a rental approval from the owner's electronic device, the system 100 may proceed as described below. Upon receiving a rental disapproval, the server 108 may identify another particular vehicle to satisfy the vehicle rental request.

Upon identifying the particular vehicle 104 to satisfy the vehicle rental request, the server 108 is configured to transmit a vehicle assignment to the electronic device 102. The vehicle assignment may include (i) a location of the particular vehicle 104 (e.g., as an address, as geospatial coordinates, as a location on a map, in relation to points of interest, etc.) and (ii) identification information associated with the particular vehicle 104 (e.g., make, model, license plate number, color, year, etc.).

The user/renter may utilize the vehicle assignment received via their electronic device 102 to locate and identify the particular vehicle 104 for satisfying the vehicle rental request. Once located, the system 100 provides a variety of ways in which the rental vehicle 104 may be unlocked.

According to one implementation, the user/renter may issue an unlock request from their electronic device 102 (e.g., via the renter-side peer-to-peer vehicle sharing application executing on the electronic device 102). In one example of this implementation, the unlock request may be transmitted from the electronic device 102 to the server 108. The server 108 may then issue a corresponding unlock command via the distributed computing system 106 and/or satellite network 118 to the rental vehicle 104 (which may be received by the vehicle's transceiver 114) causing the vehicle 104 to unlock its doors. In another example of this implementation, the user/renter may transmit an unlock request from their electronic device 102 (e.g., via the renter-side peer-to-peer vehicle sharing application executing on the electronic device 102), which may be received directly by the key fob 110 (e.g., via one or more transceivers included as part of the key fob 110). In this example, the key fob 110 is configured to (i) obtain the unlock request and (ii) transmit an unlock command to the vehicle 104 in response thereto, causing the vehicle 104 to unlock its doors. According to one example of the foregoing implementation, a controller of the key fob 110 may activate (e.g., "wake-up" from a low-power state, or hibernation) at predefined intervals and the key fob 110 (e.g., a vehicle control circuit of the key fob 110, as described below) only transmits the unlock command following an authentication process (discussed below).

In another implementation, the server 108 is configured to transmit the unlock command to the vehicle 104 without the user issuing an unlock request from their electronic device 102. In one example of this implementation, the server 108 is configured to transmit an unlock command to the vehicle 104 in response to determining that the user's electronic device 102 is within a predetermined proximity of the rental vehicle 104. The server 108 is configured to determine whether the user's electronic device 102 is within the predetermined proximity based on (i) the location of the rental vehicle 104 and (ii) the location of the electronic device 102 (which information may be obtained directly from the electronic device 102, according to some examples).

Once unlocked, the user/renter may start the vehicle's ignition and make use of the vehicle as follows. Upon entering the vehicle, the user may locate the key fob 110. According to some examples, the key fob 110 includes a controller activation input (discussed in additional detail below with regard to FIG. 3A). The user may generate an input command via the controller activation input, which causes the controller of the key fob 110 to activate (e.g., awaken from a low-energy, power-conservation state, or hibernation). Upon activation, the controller of the key fob 110 is configured to authenticate the user's electronic device. Authentication may occur via the electronic device 102 communicating with the controller of the key fob 110 (e.g., via a transceiver of the key fob 110, discussed in additional detail below with regard to FIGS. 3A-3B) using authentication techniques known in the art. In addition, reservation information associated with the user's reservation request (e.g., the rental period (defining the scheduled duration of the vehicle rental)) may be communicated from the user's electronic device 102 to the controller of the key fob 110. As discussed in additional detail below, the reservation information may be used to modify the state of the controller (e.g., to determine when the controller should be active or inactive).

Upon the controller of the key fob 110 authenticating the user/renter's electronic device 102, the controller is configured to cause the battery of the key fob 110 to energize the vehicle control circuit of the key fob 110. Once energized, the vehicle control circuit is configured to transmit a fob enablement beacon indicating that the key fob 110 is enabled. The fob enablement beacon may be received by the rental vehicle 104. According to some examples, receipt of the fob enablement beacon by the vehicle 104 may serve as a precondition for the vehicle 104 starting. For example, according to some implementations, the user/renter may attempt to start the vehicle (e.g., by pushing a start button, turning a key in an ignition, etc.). The vehicle 104 (i.e., the transceiver 114 of the vehicle 104) may then scan for the presence of the fob enablement beacon. Once the fob enablement beacon is detected by the vehicle 104, the vehicle 104 may start.

According to one example, the controller of the key fob 110 is configured to deactivate (e.g., enter a low-power consumption, or hibernation, state) within a predetermined period of time after causing the battery to energize the vehicle control circuit. This may help preserve the battery life of the key fob 110 while the vehicle 104 is in use by the user/renter. According to some examples, the controller may stay in a deactivated state for substantially the duration of the rental (i.e., for the rental period) and may reactivate as follows.

In one example, the controller may reactivate from its deactivation state upon receiving another controller activation command (e.g., as obtained via user generating an input command via the controller activation input). In another example, the controller may reactivate after a predetermined period of time has passed (as measured, for example, by a timer (shown and described with regard to FIG. 4)). In one example, the predetermined period of time may correspond to the duration of the scheduled rental. Thus, for example, if a user rented the vehicle for three hours (i.e., for a three hour rental period), the controller may reactivate after the three-hour rental window has closed.

Upon reactivating (e.g., because the rental period has expired), according to one example, the controller may de-energize the vehicle control circuit by preventing the battery from supplying power to the vehicle control circuit. Following vehicle control circuit de-energization, the controller itself may deactivate.

Figure 3A:
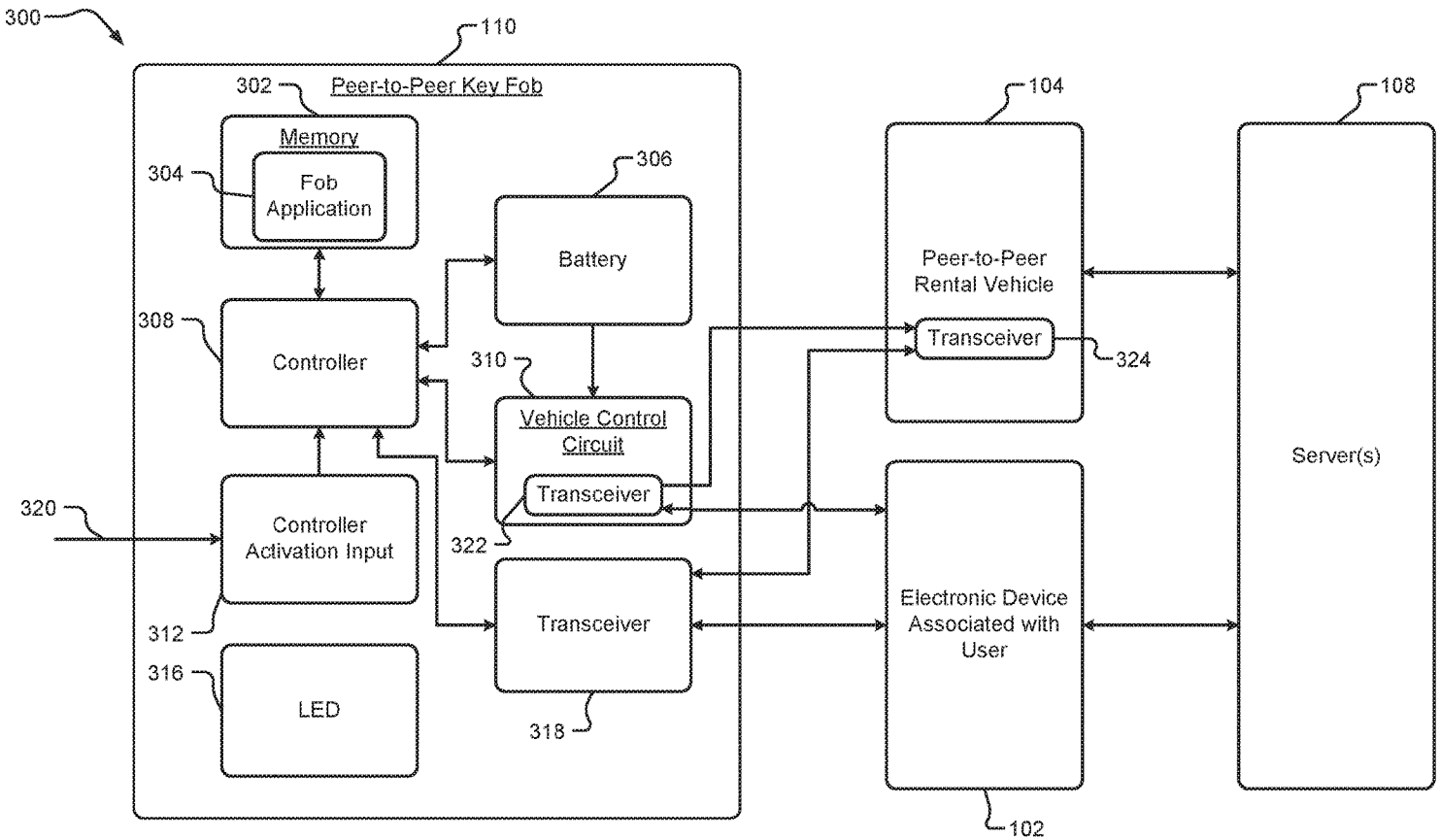
FIG. 3A is another functional block diagram of a system for providing peer-to-peer vehicle sharing according to an exemplary embodiment.
Figure 3B:
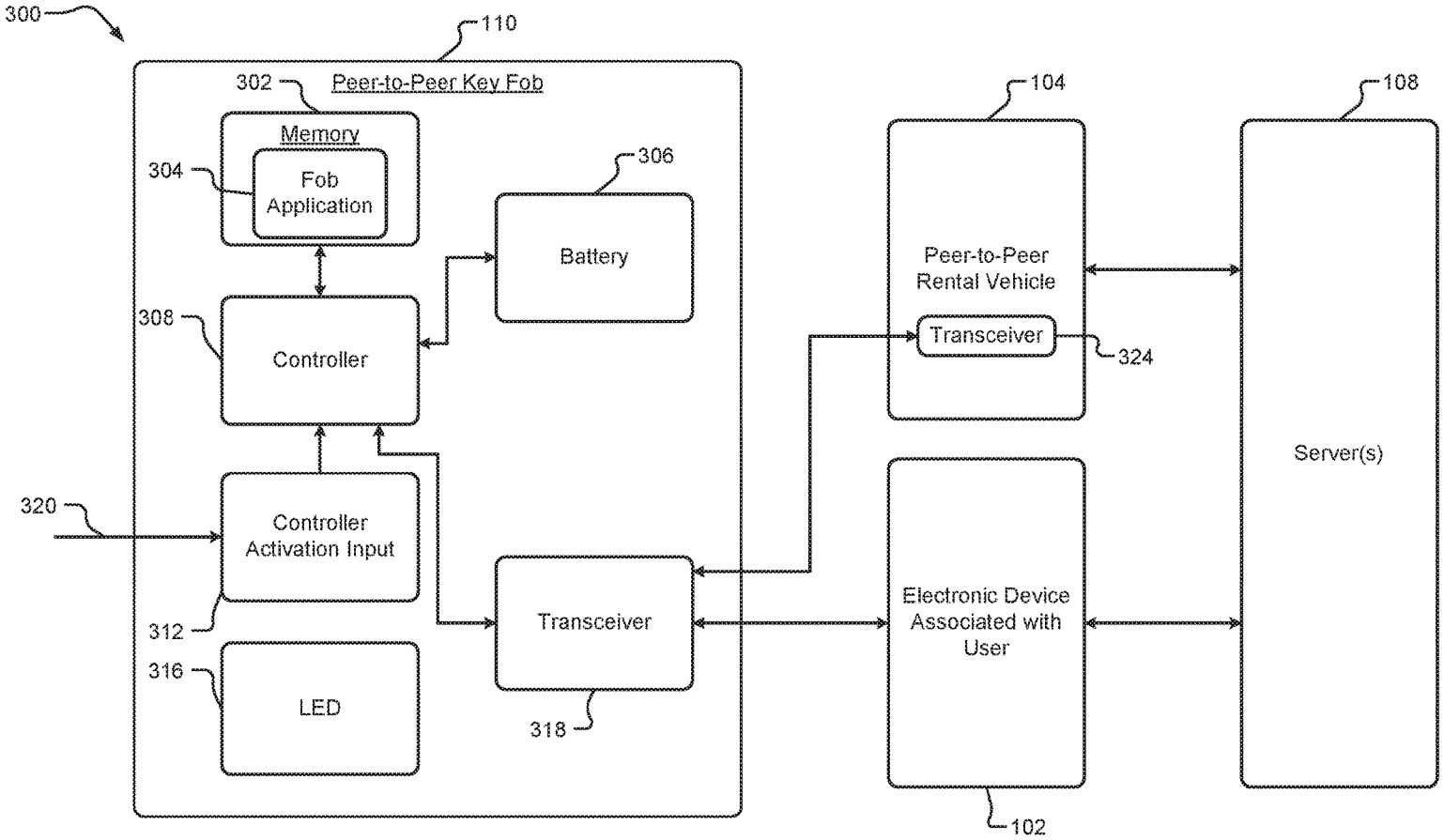
FIG. 3B is another functional block diagram of a system for providing peer-to-peer vehicle sharing according to an exemplary embodiment.

In one example, the controller is configured to transmit an intent-to-deactivate signal (e.g., via a transceiver of the key fob shown and described with regard to FIGS. 3A-3B) to the user/renter's electronic device 102 and/or the rental vehicle 104, itself, prior to deactivation. The intent-to-deactivate signal may include a signal indicating that the controller of the key fob 110 will deactivate in a predetermined period of time. In one example, the server 108 is configured to obtain the intent-to-deactivate signal from the electronic device 102 and/or the vehicle 104, and identify the particular vehicle 104 as available for rental in response thereto (e.g., by updating the state of the vehicle in a database entry associated with the vehicle 104 or the like).

According to another example, the system 100 is configured to remotely enable and/or disable one or more functions of the key fob 110 as follows. A user/renter may issue a vehicle rental request as described above. The server 108 may identify a vehicle to satisfy the request and transmit a vehicle assignment to the electronic device 102 as described above.

In one implementation of this example, the server 108 may wait until (i) the user's electronic device 102 is within a predetermined proximity from the vehicle 104 and (ii) the user issues a door unlock request via their electronic device 102. Upon both of the foregoing conditions being satisfied, the server 108 may unlock one or more of the doors of the vehicle 104 and may issue a remote enablement command to the key fob 110. The remote enablement command may be transmitted from the server 108 to the key fob 110 via the transceiver 114 of the vehicle 104. The remote enable command may indicate, at least, the rental period for the vehicle 104 associated with the key fob 110. In this manner, the key fob may be enabled for the rental period and available for use by the user/renter. In addition, and as noted above, the remote enable command is configured to enable one or more functions of the key fob 110 during the rental period.

In another implementation of the preceding example, rather than waiting for the user's electronic device 102 to be within a predetermined proximity from the vehicle 104 and for the user to issue a door unlock request via their electronic device 102 before enabling the key fob 110, the server 108 may transmit server-side device authentication data to the key fob 110. The server-side device authentication data may identify the electronic device 102 associated with the rental request (e.g., via a device ID, signature, etc.) and may indicate that the device 102 may be trusted. The server-side device authentication data may additionally indicate the duration of the rental. The electronic device 102 may transmit device-side authentication data to the key fob 110. The device-side authentication data may also identify the electronic device 102 associated with the rental request (e.g., via a device ID, signature, etc.). The key fob 110 may compare the server-side device authentication data with the device-side authentication data. Upon determining that the server-side device authentication data correlates to the device-side authentication data (e.g., determining that the device IDs and/or signatures match), the electronic device 102 may be authenticated. Following device authentication, the one or more doors of the vehicle may be unlocked and the key fob may be enabled for use during the rental period. In this manner, one or more functions of the key fob may be enabled based on the authentication of the electronic device. In the preceding example, the door(s) may be unlocked by the key fob 110 issuing an unlock command to the vehicle 104, or via the server 108 issuing an unlock command to the vehicle 104 after being notified of the device authentication. With the one or more doors of the vehicle 104 unlocked and the key fob 110 enabled, the user/renter may make use of the vehicle for the rental period.

Figure 2:
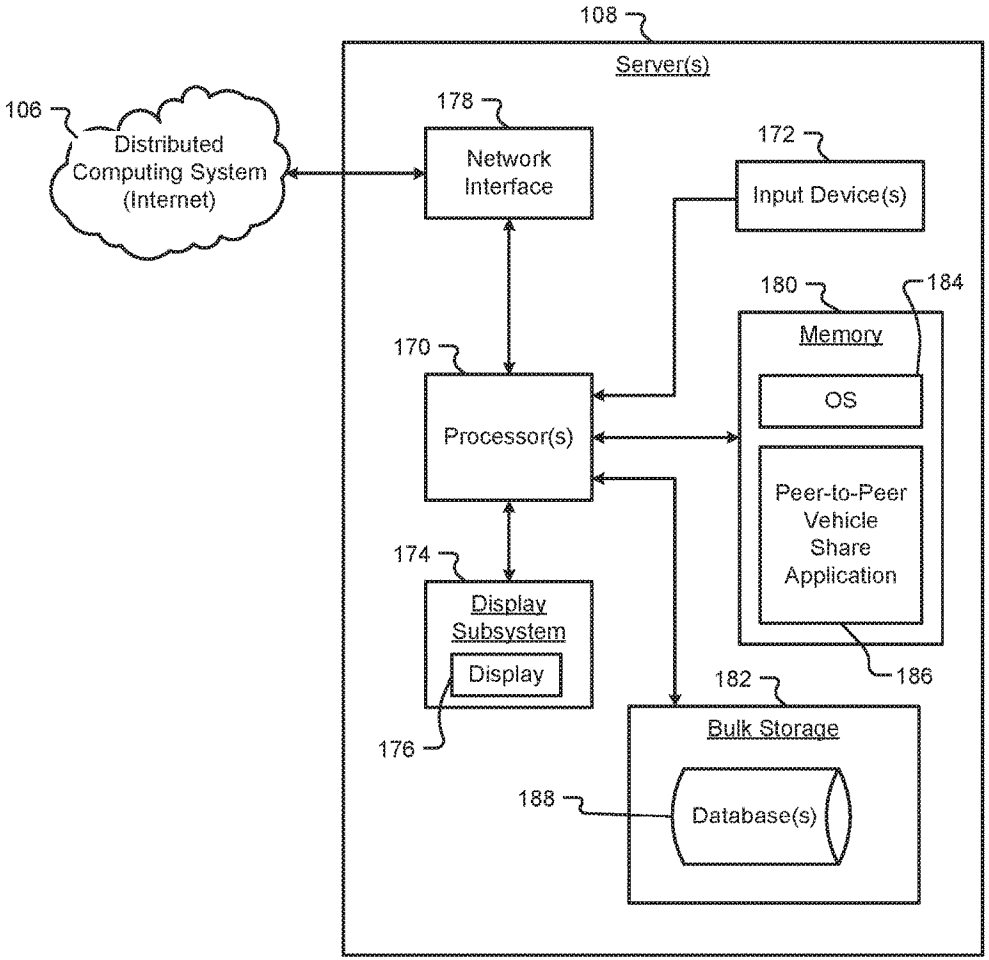
FIG. 2 is a functional block diagram of one or more server computers for use as part of a peer-to-peer vehicle sharing system according to an exemplary embodiment.

Referring now to FIG. 2, a simplified functional block diagram of exemplary one or more servers 108 configured for use as part of a peer-to-peer vehicle sharing system (such as the system 100 described with regard to FIG. 1) is shown. According to one example, the server(s) 108 may be implemented as one or more server computers or the like located remotely from the rental vehicle and user/renter's electronic device.

The server(s) 108 include one or more processors 170, one or more input devices 172 (e.g., a keyboard, touchpad, mouse, etc.), a display subsystem 174 including a display 176, a network interface 178, a memory 180, and a bulk storage 182. While the input devices 172 and the display 176 are illustrated as components of the server(s) 108, input devices and output devices (e.g., a display) may be peripheral devices.

The network interface 178 connects the server(s) to one or more rental vehicles and one or more electronic devices (e.g., electronic devices associated with user/renters and/or vehicle owners) via the distributed computing system 106. For example, the network interface 178 may include a wired interface (e.g., an Ethernet interface) and/or a wireless interface (e.g., a Wi-Fi, Bluetooth, near field communication (NFC), or other wireless interface). The memory 180 may include volatile or nonvolatile memory, cache, or other type of memory. The bulk storage 182 may include flash memory, one or more hard disk drives (HDDs), or other bulk storage device.

The processor(s) 170 execute an operating system (OS) 184 and one or more server applications, such as a peer-to-peer vehicle share application 186. The bulk storage 182 may store one or more databases 188 that store data structures used by the server applications to perform functions described herein. The processor(s) 170 execute the peer-to-peer vehicle share application 186 to perform functions attributed to the server(s) 108 herein including, but not limited to, obtaining vehicle rental requests, identifying vehicles to satisfy vehicle rental request, maintaining the states of rental vehicle, transmitting vehicle assignments, transmitting vehicle unlock commands, transmitting key fob enablement commands, transmitting server-side device authentication data, determining vehicle and/or electronic device location, etc. Operations discussed herein as being performed by the server(s) 108 are performed by the server(s) 108 (more specifically the processor(s) 170) during execution of the peer-to-peer vehicle share application 186.

FIG. 3A is a functional block diagram of a system 300 for providing peer-to-peer vehicle sharing. The system 300 may be substantially similar to the system 100 discussed above with regard to FIG. 1. However, FIG. 3A illustrates additional details concerning the peer-to-peer dedicated key fob 110 described above.

As shown, the system 300 includes a key fob 110, a peer-to-peer rental vehicle 104 having a transceiver 324, an electronic device 102 associated with a user/renter, and one or more servers 108. As with FIG. 1, although only a single vehicle 104 and single electronic device 102 are shown, according to certain examples, two or more vehicles and/or two or more electronic devices may be included within the system 300 without deviating from the teachings herein.

The key fob 110 includes memory 302, a battery 306, a controller 308, a vehicle control circuit 310 having a dedicated transceiver 322, a controller activation input 312, a transceiver 318, and, optionally, a light-emitting-diode (LED) 316.

The memory 302 includes a fob application 304 that may be executed by the controller 308 to perform functions attributed to the key bob 110 generally and/or controller 308 specifically herein including, but not limited to, controller activation/deactivation/reactivation, authentication of the electronic device 102, causing the battery 306 to energize the vehicle control circuit 310, de-energizing the vehicle control circuit 310 by preventing the battery 306 from supplying power to the vehicle control circuit 310, transmitting an intent-to-deactivate signal, etc.

As noted above, the battery 306 may include any suitable disposable or rechargeable battery known in the art. According to some examples, the battery 306, under the control of the controller 308, is configured to energize the vehicle control circuit 310.

The controller activation input 312 may include any suitable input mechanism known in the art including, but not limited to, a mechanical button, a touchscreen, a switch, etc. The controller activation input 312 is configured to (i) obtain user input 320 and (ii) generate a controller activation command to the controller 308 in response thereto. The controller activation command is configured to cause the controller 308 to activate or reactivate (e.g., "wake up") from a deactivate state, as described above. According to some examples (e.g., when the controller 308 is activated), the controller activation input 312 may serve to deactivate the controller 308. In this example, the controller activation input 312 is configured to (i) obtain user input 320 and (ii) generate a controller deactivation command to the controller 308 in response thereto. The controller deactivation command is configured to cause the controller 308 to deactivate from an activate state, as described above.

The vehicle control circuit 310 is configured to transmit a fob enablement beacon to the vehicle 104 when energized by the battery 306. The fob enablement beacon may be transmitted from the transceiver 322 of the vehicle control circuit 310 to a transceiver of the vehicle (e.g., transceiver 14 shown with regard to FIG. 1). In some examples, the vehicle control circuit 310 is further configured to (i) obtain an unlock request from the electronic device 102 and (ii) transmit an unlock command to the vehicle 104 in response thereto. As noted above, in some examples, the vehicle control circuit 310 is configured to communicate (via the transceiver 322 or the like) with the vehicle 104 and/or the electronic device 102 using any suitable wired or wireless communication protocol known in the art.

In the example shown in FIG. 3A, the key fob 110 also includes another transceiver 318 (i.e., a transceiver 318 that is separate from the vehicle control circuit's transceiver 322). The transceiver 318 may include any suitable communications device capable of wired or wireless communication with the electronic device 102 and/or vehicle 104. In on example, the transceiver 318 may constitute a Bluetooth Low Energy (BLE) module or the like. The transceiver 318 is configured to, among other things, facilitate communication between the controller 308 and the electronic device 102 and/or vehicle 104.

According to some examples, the key fob 110 may also include a LED 316, which may also be energized by the battery 306. The LED 316 may light up to indicate, for example, a user input command to the controller activation input 312.

As described in additional detail above with reference to FIG. 1, the controller 308 of the key fob 110 is configured to activate (i) in response to obtaining a controller activation command from the controller activation input 312; (ii) at predefined intervals; or (iii) after a predetermined period of time has passed (e.g., as measured by a timer included as part of the key fob 110 (shown with regard to FIG. 4)). In addition, the controller 308 of the key fob 110 is configured to deactivate (i) in response to obtaining a controller deactivation command from the controller activation input 312; (ii) at predefined intervals; or (iii) after a predetermined period of time has passed (e.g., as measured by a timer included as part of the key fob 110 (shown with regard to FIG. 4)).

In further conjunction with the discussion provided above with regard to FIG. 1, the controller 308 is configured to perform the following functions while in an active state: (i) authenticating the electronic device 102; (ii) causing the battery 306 to energize the vehicle control circuit 301; (iii) de-energizing the vehicle control circuit 310 by preventing the battery 306 from supplying power to the vehicle control circuit 310; and/or (iv) transmitting an intent-to-deactivate signal to the vehicle 104 and/or electronic device 102.

In addition, according to some examples, the controller 308 is configured to enable one or more functions of the key fob 110 during the rental period based on a remote enablement command received from the server(s) 108. Similarly, according to some examples, the controller 308 is configured to disable one or more functions of the key fob 110 before, during, or after the rental period based on a remote disablement command received from the server(s) 108. In one example, the controller 308 is configured to disable one or more functions of the key fob 110 in response to obtaining a rental period expiration notification from a timer of the key fob 110. Further still, according to some examples, the controller 208 is configured to transition the key fob from a first energy state (e.g., a high energy state) to a second energy state (e.g., a low energy state) during the rental period in response to one or more functions of the key fob being enabled.

The electronic device 102, vehicle 104, and server(s) 108 of FIG. 3 may function substantially in accordance with the descriptions of those elements provided above with regard to FIGS. 1-2.

FIG. 3B illustrates another example of the key fob 110. According to the example shown in FIG. 3B, functions attributed to the vehicle control circuit 310 of FIG. 3A are performed, instead, by the controller 308 executing the fob application 304. Thus, FIG. 3B may reflect another suitable implementation of the key fob 110 according to aspects of the present disclosure.

Figure 4:
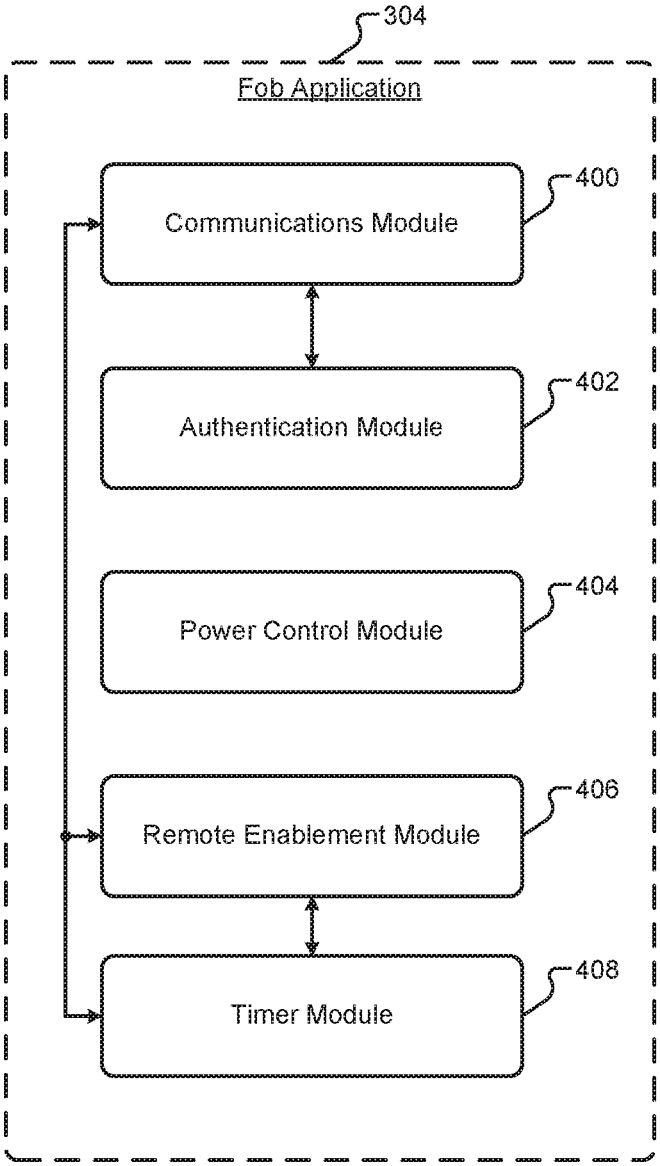
FIG. 4 is a functional block diagram of a Fob application for controlling a key fob utilized as part of a system for providing peer-to-peer vehicle sharing according to an exemplary embodiment.

Referring now to FIG. 4, one example of the fob application 304 of FIGS. 3A-3B is shown. As shown, the fob application 304 includes a communications module 400, an authentication module 402, a power control module 404, a remote enablement module 406, and a timer module 408.

The communications module 400 is configured to, among other things, obtain a remote enablement command (e.g., from the server(s) 108) indicating, at least, a rental period for a vehicle (e.g., the vehicle 104) associated with the key fob (e.g., the key fob 110). In addition, according to some examples, the communications module is configured to obtain (i) device-side authentication data from an electronic device associated with the user/renter (e.g., electronic device 102) and/or (ii) server-side device authentication data from the server(s) (e.g., the server(s) 108).

The authentication module 402 is configured to, among other things, compare the device-side authentication data with the server-side device authentication data. According to some examples, if the device-side authentication data correlates to the server-side device authentication data (thus indicating, that the electronic device communicating with the key fob is the same electronic device that requested the vehicle rental), the authentication module 402 is configured to authenticate the electronic device.

The power control module 404 is configured to, among other things, transition the key fob (e.g., key fob 110) from a first energy state to a second energy state that is different than the first energy state. According to some examples, the power control module 404 is configured to effectuate the transition during the rental period. According to some examples, the power control module 404 is configured to effectuate the transition in response to the remote enable module 406 enabling one or more functions of the key fob.

The remote enablement module 406 is configured to, among other things, enable one or more functions of the key fob, for example, during the rental period, based on the remote enablement command obtained from the server via the communications module 400. In one example, the remote enablement module 406 is configured to enable the one or more functions of the key fob based on the authentication module 402 authenticating the electronic device. In another example, the remote enablement module 406 is configured to disable one or more functions of the key fob in response to obtaining a rental period expiration from the timer module 408, as discussed below.

The timer module 408 is configured to, among other things, start a timer at a beginning of the rental period. In addition, the timer module 408 is configured to stop the timer at an end of the rental period. Further, according to some examples, the timer module 408 is configured to transmit a rental period expiration notification to the remote enablement module 406 at the end of the rental period.

Figure 5:
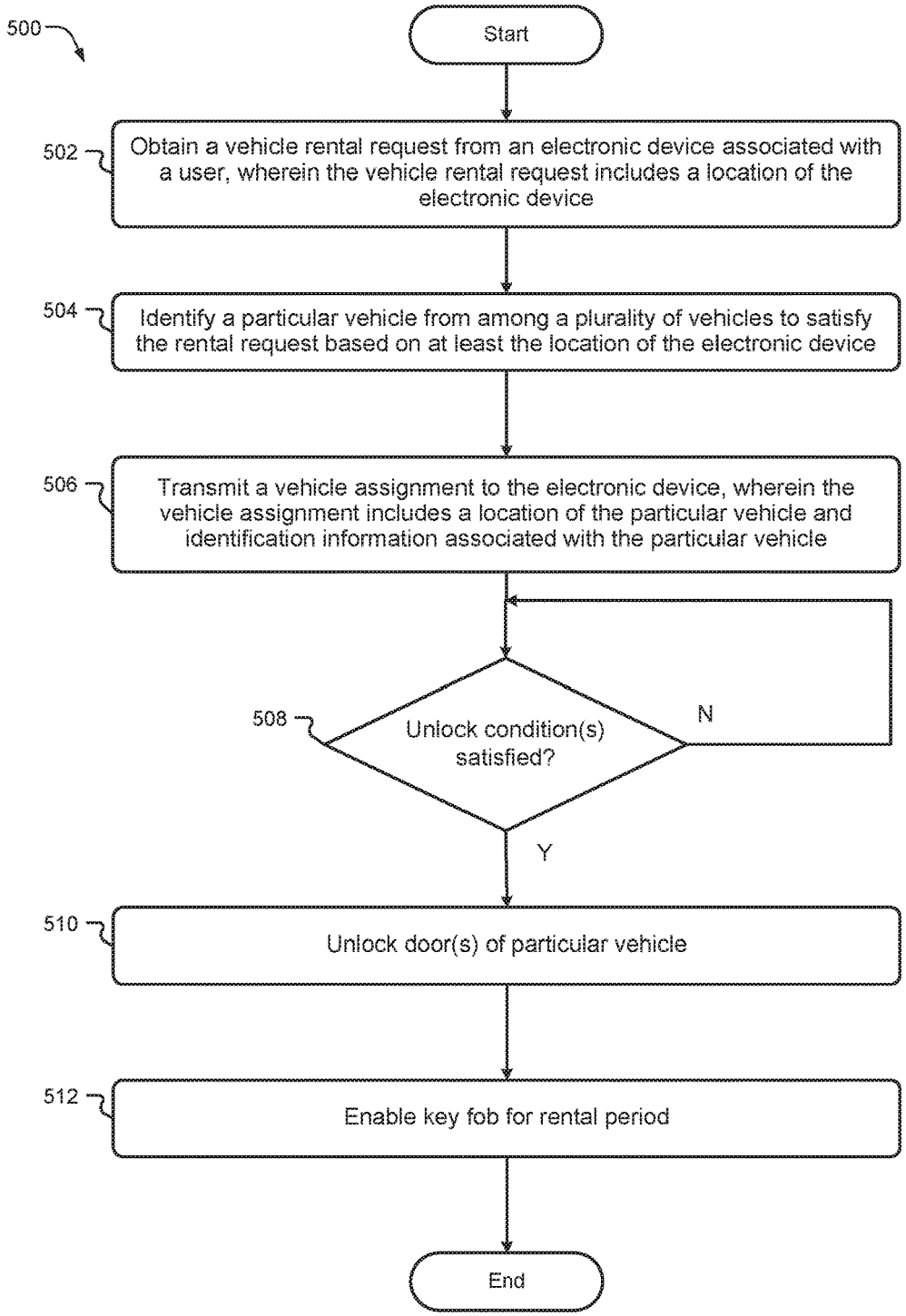
FIG. 5 is a flowchart of a method for peer-to-peer vehicle sharing according to an exemplary embodiment.

Referring now to FIG. 5, a flowchart depicting one example of a method 500 for peer-to-peer vehicle sharing is provided. The method 500 of FIG. 5 may be carried out, according to some examples, by one or more servers (e.g., server(s) 108 or the like). The method 500 beings at 502 where a vehicle rental request is obtained from an electronic device associated with a user. The vehicle rental request may include a location of the electronic device. At 504, a particular vehicle is identified from among a plurality of vehicles to satisfy the rental request. The identification of the particular vehicle may be based on at least the location of the electronic device. At 506, a vehicle assignment may be transmitted to the electronic device. The vehicle assignment may include a location of the particular vehicle and identification information associated with the particular vehicle.

At 508, a determination is made as to whether one or more unlock conditions associated with the vehicle have been satisfied. As noted above, unlock conditions may include, by way of example and not limitation, receipt of an unlock request, a determination that the electronic device is within a predetermined proximity from the vehicle (e.g., 5 feet), etc. If one or more of the unlock conditions have not been satisfied, the method 500 waits until one or more unlock conditions are satisfied.

Once one or more unlock conditions have been satisfied, the method 500 proceeds to 510 where one or more doors of the vehicle are unlocked. At 512, one or more functions of a key fob associated with the particular vehicle are enabled. Following 512, the method 500 concludes.

Figure 6:
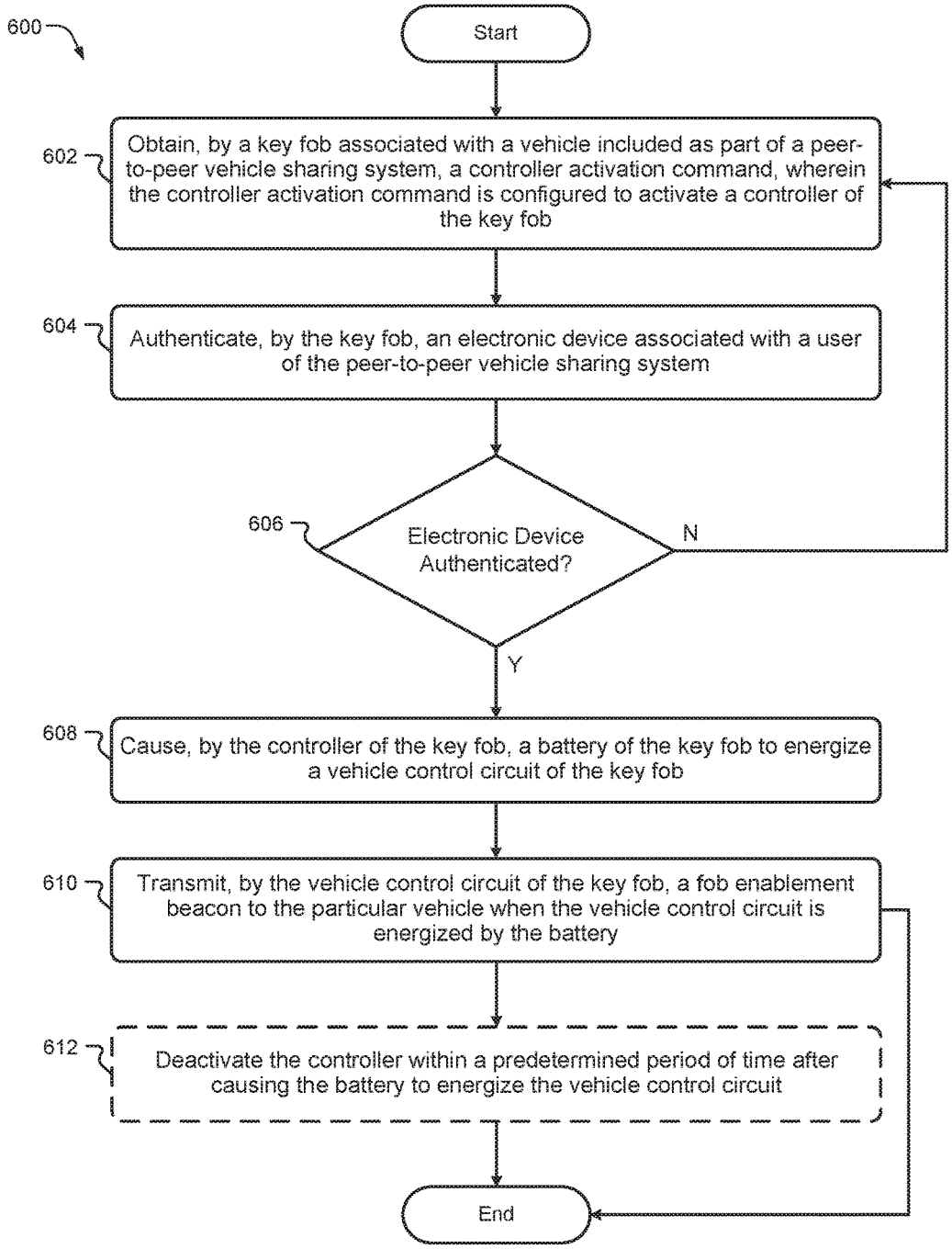
FIG. 6 is a flowchart of another method for peer-to-peer vehicle sharing according to an exemplary embodiment.

Referring now to FIG. 6, a flowchart depicting one example of a method 600 for peer-to-peer vehicle sharing is provided. The method 600 begins at 602 where a controller activation command is obtained by a key fob associated with a vehicle included as part of a peer-to-peer vehicle sharing system. The controller activation command is configured to activate a controller of the key fob. At 604, an electronic device associated with a user of the peer-to-peer vehicle sharing system is authenticated by the key fob. At 606, a determination is made as to whether the electronic device was authenticated. If not, the method 600 returns to 602.

If, however, the electronic device is authenticated, the method 600 proceeds to 608 where a battery of the key fob is caused to energize a vehicle control circuit of the key fob. The controller of the key fob may control the battery to cause it to energize the vehicle control circuit. At 610, a fob enablement beacon (indicating that the key fob is enabled) is transmitted to the particular vehicle when the vehicle control circuit is energized by the battery. According to one example, the method 600 concludes following 610. However, in another example, the method 600 proceeds following 610 to optional step 612 where the controller is deactivated within a predetermined period of time after causing the battery to energize the vehicle control circuit.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A key fob for peer-to-peer vehicle sharing, comprising:
a communication module configured to:
obtain a remote enablement command indicating a rental period for a vehicle associated with the key fob;
a remote enablement module configured to:
enable one or more functions of the key fob during the rental period based on the remote enablement command; and
a power control module configured to:
transition the key fob from a first energy state to a second energy state during the rental period in response to the remote enablement module enabling the one or more functions of the key fob.

2. The key fob of claim 1, wherein the communications module is further configured to:
obtain first authentication data from an electronic device associated with a user; and
obtain second authentication data from a server.

3. The key fob of claim 2, further comprising:
an authentication module configured to:
compare the first authentication data with the second authentication data; and
authenticate the electronic device associated with the user if the first authentication data correlates to the second authentication data.

4. The key fob of claim 3, wherein the remote enablement module is configured to:
enable the one or more functions based on the authentication module authenticating the electronic device.

5. The key fob of claim 1, further comprising:
a timer module configured to:
start a timer at a begging of the rental period;
stop the timer at an end of the rental period; and
transmit a rental period expiration notification to the remote enablement module at the end of the rental period.

6. The key fob of claim 5, wherein the remote enablement module is further configured to:
disable the one or more functions of the key fob in response to obtaining the rental period expiration notification.

7. The key fob of claim 1, wherein the first energy state comprises a higher energy state than the second energy state.

8. A server comprising:
a processor;
memory;
a peer-to-peer vehicle share application that is stored in the memory and executed by the processor and that is configured to:
obtain a vehicle rental request from an electronic device associated with a user, wherein the vehicle rental request comprises a location of the electronic device;
identify a particular vehicle from among a plurality of vehicles to satisfy the vehicle rental request based on at least the location of the electronic device;
transmit a vehicle assignment to the electronic device, wherein the vehicle assignment comprises a location of the particular vehicle and identification information associated with the particular vehicle;
determine whether an unlock condition associated with the particular vehicle has been satisfied;

in response to determining that the unlock condition associated with the particular vehicle has been satisfied, unlock one or more doors of the particular vehicle; and transmit a remote enablement command to enable a key fob associated with the particular vehicle for a rental period, wherein the remote enablement command causes the key fob to transition from a first energy state to a second energy state during the rental period.

9. The server of claim 8, wherein the peer-to-peer vehicle share application is configured to determine whether the unlock condition associated with the particular vehicle has been satisfied by obtaining a vehicle unlock request from the electronic device associated with the user.

10. The server of claim 8, wherein the peer-to-peer vehicle share application is configured to determine whether the unlock condition associated with the particular vehicle has been satisfied by determining that the electronic device associated with the user is within a predetermined proximity of the particular vehicle.

11. The server of claim 10, wherein the peer-to-peer vehicle share application is configured to determine that the electronic device associated with the user is within the predetermined proximity of the particular vehicle by comparing the location of the electronic device with the location of the particular vehicle.

12. The server of claim 8, wherein the peer-to-peer vehicle share application is configured to enable the key fob associated with the particular vehicle by transmitting an enablement command to a transceiver of the particular vehicle.

13. The server of claim 8, wherein the peer-to-peer vehicle share application is further configured to:

transmit authentication data associated with the electronic device to the key fob.

14. The server of claim 13, wherein the peer-to-peer vehicle share application is configured to transmit the authentication data associated with the electronic device to the key fob via a transceiver of the particular vehicle.

15. A key fob for peer-to-peer vehicle sharing, comprising:

a battery;

a vehicle control circuit connected to the battery and configured to:

transmit a fob enablement beacon, indicating that the key fob has been enabled, to a particular vehicle associated with the key fob when the vehicle control circuit is energized by the battery;

a controller configured to:

activate in response to obtaining a controller activation command;

authenticate an electronic device associated with a user; and in response to authenticating the electronic device, cause the battery to energize the vehicle control circuit.

16. The key fob of claim 15, wherein the controller is further configured to:

deactivate within a predetermined period of time after causing the battery to energize the vehicle control circuit.

17. The key fob of claim 16, wherein the controller is further configured to:

reactivate, after being deactivated.

18. The key fob of claim 17, wherein the controller is configured to reactivate after at least one of the following:

obtaining another controller activation command; and a predetermined period of time has passed.

19. The key fob of claim 18, wherein the controller is further configured to:

de-energize the vehicle control circuit by preventing the battery from supplying power to the vehicle control circuit.

* * * * *